US006786755B2

(12) United States Patent
Dambach et al.

(10) Patent No.: US 6,786,755 B2
(45) Date of Patent: Sep. 7, 2004

(54) DIFFERENTIAL SIGNAL CONNECTOR ASSEMBLY WITH IMPROVED RETENTION CAPABILITIES

(75) Inventors: Philip J. Dambach, Naperville, IL (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/400,241

(22) Filed: Mar. 27, 2003

(65) Prior Publication Data

US 2003/0186580 A1 Oct. 2, 2003

Related U.S. Application Data

(60) Provisional application No. 60/367,953, filed on Mar. 27, 2002.

(51) Int. Cl.[7] ..... H01R 13/627

(52) U.S. Cl. ..... 439/353; 439/357

(58) Field of Search ..... 439/357, 607, 439/608, 609, 610, 441, 579, 497, 350, 65, 353

(56) References Cited

U.S. PATENT DOCUMENTS

| | | | | |
|---|---|---|---|---|
| 4,824,383 A | | 4/1989 | Lemke | 439/108 |
| 5,454,726 A | * | 10/1995 | Lee et al. | 439/65 |
| 5,472,354 A | * | 12/1995 | Chen et al. | 439/357 |
| 6,123,575 A | | 9/2000 | Huang et al. | 439/489 |
| 6,280,209 B1 | | 8/2001 | Bassler et al. | 439/101 |
| 6,350,134 B1 | * | 2/2002 | Fogg et al. | 439/79 |

FOREIGN PATENT DOCUMENTS

| | | | |
|---|---|---|---|
| EP | 0 853 352 A2 | 7/1998 | H01R/3/00 |
| WO | WO 02/101883 A2 | 12/2002 | H01R/13/00 |

OTHER PUBLICATIONS

International Search Report in counterpart PCT Application No. PCT/US03/09387, mailed Jul. 7, 2003.

* cited by examiner

*Primary Examiner*—Ross Gushi
(74) *Attorney, Agent, or Firm*—Thomas D. Paulius

(57) ABSTRACT

A connector provides mechanical strength and impedance-conforming coupling between conductors in a cable and conductors on a circuit board. The conductors in the cable and the circuit board carry differential signals. The connector is comprised of a dielectric plug that has conductive terminals installed in it which comprise an electrical triad. A dielectric inner body has at least one triplet of three conductive terminals that extend into corresponding slots of the dielectric plug. The dielectric inner body has latching arm slots that receiving a latching arm of a mechanical coupling link member. A protective cover extends over a wire management support member and the dielectric inner body portion and at least partially over the dielectric plug member. The protective cover has retention openings that engage an actuator leg of a latching member. The protective cover also has at least one bias leg recess, for receiving a bias leg of the latching member. A latching member has bias legs that extend into the bias leg passages of the dielectric plug member. The latching member locks the dielectric plug member, the dielectric inner body and the protective cover together.

22 Claims, 8 Drawing Sheets

DIFFERENTIAL SIGNAL CONNECTOR ASSEMBLY WITH IMPROVED RETENTION CAPABILITIES

REFERENCE TO RELATED APPLICATIONS

This application claims priority from U.S. Provisional patent application Ser. No. 60/367,953, filed Mar. 27, 2002.

BACKGROUND OF THE INVENTION

The present invention relates generally to connectors used to connect together differential signal circuits, and more preferably to a connector assembly for connecting together differential signal circuits that incorporates a latching signal circuits that incorporates a latching assembly to provide increased retention forces to maintain the connector assembly together in a metal state.

Connectors used in differential signal applications are known in the art. Some of these connectors arrange their terminals in a signal-signal-ground pattern. However, patterns such as these have problems with controlling the impedance of the connector through the mating and termination regions of the connectors. The impedance of the terminals can be controlled by using a triangular pattern, referred to as a "triad" in U.S. Pat. No. 6,280,209, issued Aug. 28, 2001 to the assignee of the present invention. In these triads, two differential signal terminals and an associated ground terminal and arranged are arranged in a triangular pattern so that the terminals are positioned at the apexes of the triangular pattern. Using a number of these triads and inverting them so that some triangular patterns are upright and the intervening triangular patterns are turned upside down, or inverted is one way of increasing density of the terminals in connectors. This arrangement is disclosed in copending International Patent Application No. PCT/US02/18372, filed Jun. 11, 2001 and also owned by the assignee of the present invention.

However, in the connectors described in these patent or applications, the manner of engagement utilized is either housing-to-housing or shield-to-shield frictional contact. Although this sufficient to retain the connectors together in normal connections, it is not sufficient to retain the connectors together under rough connection and disconnection cycles, or bear the weight of heavier cables that contain multiple sets, such as six or more, of differential signal cables, each with their own associated ground. Retention of the connectors is important to maintain the connectors and their terminals together.

Accordingly, the present invention is directed to a differential signal connector assembly that uses "triad" terminal arrangements and which has increased retention capabilities over the prior art.

SUMMARY OF THE INVENTION

It is a general object of the present invention to provide an improved differential signal connector that uses a plurality of "triads" of terminals for connecting with a mating connector, and which utilizes a latching system to retain the connectors in a mater condition after engagement.

Another object of the present invention is to provide a connector assembly for connecting a cable to a circuit board in which the connector assembly includes first and second connectors, the first connector being terminated to a plurality of differential signal wires (and grounds) in the cable and the second connector being terminated to a differential signal circuits on a circuit board, the two connectors of the assembly having a plurality of conductive terminals arranged in at least two rows that extend widthwise of the connectors, the terminals being arranged in distinct "triads" or triplets with two differential signal terminals and one associated ground terminal arranged at apexes of imaginary triangles, the imaginary triangles of which may be arranged in an alternating, or inverted sequence within the connectors and the first connector including at least two latching members disposed therein and extending lengthwise along the first connector housing body, the latching members being engageable with stop surfaces on the second connector.

Yet another object of the present invention is to provide the latching members in the form of two elongated latching arms, each of the latching arms having a retention end that engages one or more housing, or body, portions of the second connector and a latching end disposed along a latching arm that projects forwardly of the retention end, the latching end including, in one embodiment, a hook-shaped latch that is received within a slot formed in the first connector, the latching arms extending alongside the first connector body portion into the terminal mating area thereof, but fully enclosed with an exterior shell or shield so as to prevent damage thereto.

A still further object of the present invention is to provide a latching member having a cantilevered latching arm that extends forwardly alongside its connector body portion, the latching arm terminating in a latching hook and further having a withdrawal stop member formed thereon intermediate between the latching hook and the retention end of the latching member.

Other objects, features and advantages of the invention will be apparent from the following detailed description taken in connection with the accompanying drawings.

BRIEF DESCRIPTION OF THE DRAWINGS

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
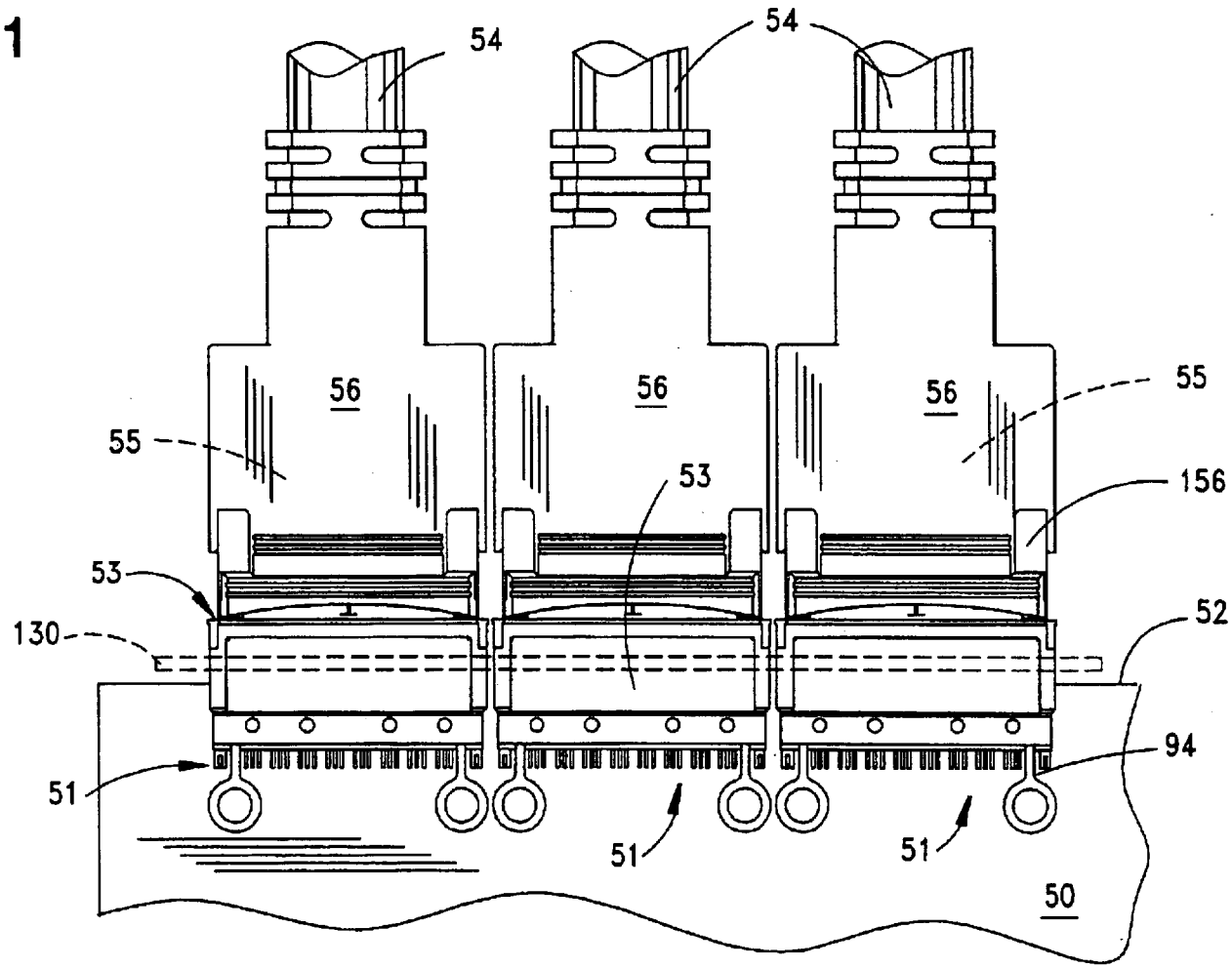
FIG. 1 is a top plan view of three connector assemblies constructed in accordance with the principles of the present invention.

The present invention is directed to a differential signal connector, particularly useful in SCSI applications with improved impedance characteristics and with improved connector retention characteristics. As shown in FIG. 1, a circuit board 50 has a plurality of circuit board connectors 51, shown as receptacle connectors with the convention "receptacle" meaning that the connector has a plurality of terminals supported thereon in an opening, or cavity, that mate with a plurality of opposing terminals that are supported on a housing that is insertable into and removable from the receptacle connector.

Three such receptacle connectors 51 are shown mounted to an edge 52 thereof. The edge 52 of the circuit board 50 may be positioned in an electronic device such as a computer or other similar electronic device. Opposing connectors 53 are provided which are mateable with the receptacle connectors 51 and these connectors 53 are terminated to cables 54 and the termination area 55 of which are enclosed within a protective flexible sheath, or cover 56, that protects the termination area in a manner that is known in the art. The receptacle connectors 51 typically extend past an edge of the circuit board 50 and the mating portions thereof typically project through a wall, or panel of a housing 130 (shown in phantom) that encloses the circuit board 50 and its components.

Figure 2:
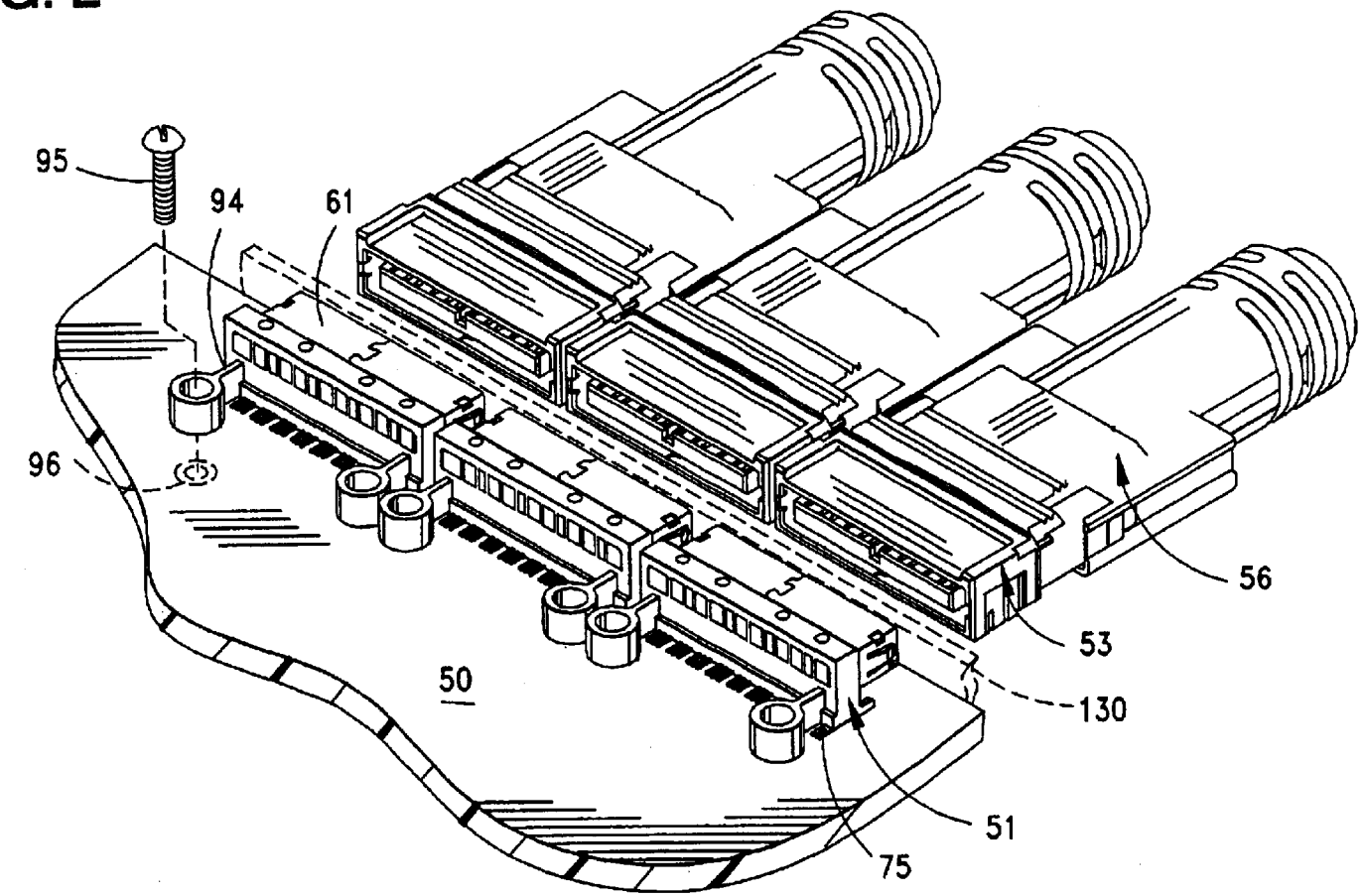
FIG. 2 is a perspective view of the connector assembly of FIG. 1 with the cable connectors removed from the circuit board connectors.
Figure 3:
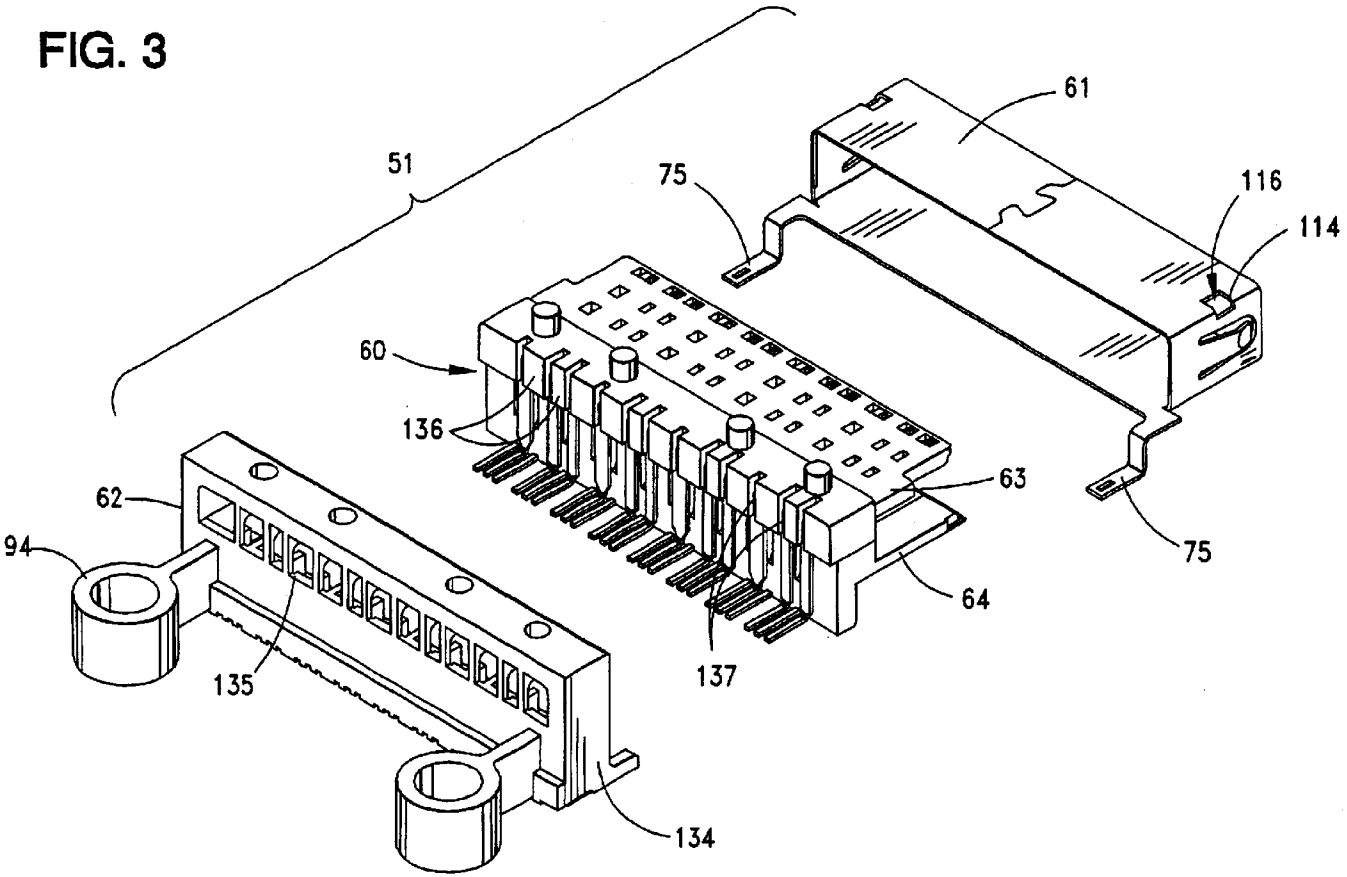
FIG. 3 is an exploded view of one of the circuit board (receptacle) connectors of the connector assembly of FIG. 1.

FIG. 2 illustrates the mating connectors 53 disengaged from their opposing receptacle connectors 51. This figure illustrates the plug nature of the cable connectors 53 having a central plug, or other portion that supports conductive terminals thereon on which is insertable into the receptacle, or cavity of the circuit board connectors 51. FIG. 3 is an exploded view of the circuit board, or receptacle connector 51, and it illustrates the main components thereof, namely: an inner housing member or terminal support structure 60, a shield member 61 that fits over and at least partially encircles a portion of the inner housing 60 and a rear or outer housing member 62. This shield member 61 is preferably attached to appropriate ground circuits on the circuit board 50 by ground tabs 75.

The inner housing member 60 is preferably formed of two parts 63, 64 that are preferably molded from an insulative material, such as a dielectric plastic. Each of these parts 63, 64 may include a respective leaf portion 65, 66 that projects forwardly from a rear wall portion 67, 68. These two leaf portions 65, 66 each support a plurality of conductive terminals 69 thereon in a particular fashion. These two housing parts 63, 64 each support, by way of their respective leaf portions, 65, 64 a single row of conductive terminals. The housing parts 63, 64 may be engaged with each other in a suitable fashion, such as by welding (plastics or ultrasonic) the two parts together, or providing them with interengaging holes 131 that receive corresponding opposing posts 132.

In order to deliver high speed performance at controlled impedance values, the terminals 69 are generally arranged in set of three, or as triads or triplets, which each terminal triplet or triad being connected to differential signal circuitry on the circuit board 50. The structural essence of these triads/triplets are explained in U.S. Pat. No. 6,280,209, issued Aug. 28, 2001, to the assignee of this invention and the disclosure of which patent is hereby incorporated by reference herein. As stated therein and as shown diagrammatically in FIG. 9, these triads each preferably include a single ground terminal 70 and a pair of signal terminals 71. The signal terminals 71 of each triad are dedicated to differential signals, e.g., signals having the same magnitude, but opposite polarities (+0.5 v & −0.5v) and the differential signal terminals are spaced apart from each other and supported on one of the leafs 66 while the associated ground terminal 70 is supported on the other leaf 65 and spaced apart from the signal terminals 71. Likewise, the ground terminal of one triad is inverted with respect to the ground terminal of an adjoining terminal triad. In this manner, the ground terminal of the one terminal triad will be supported on the one leaf portion, while the ground terminal of an adjoining terminal triad will be supported by the opposite leaf portion 66. This separation between the ground and the signal terminals occurs along two of the three extents of the terminals and is illustrated schematically in FIGS. 5*a* and 5B. Each terminal of the circuit board connector 51 may be considered as having a flat contact portion "C" preferably in the form of a wide blade, a thin mounting portion "M" (shown in FIGS. 1–4 and 5A as surface mounting feet) that extends horizontally in a plane that is spaced apart from the plane(s) in which the contact portions "C" lie, and a body portion "B" that interconnects the contact and mounting portions together. In the surface mount arrangement of FIG. 5A, the tails, or mounting portions M lie along the surface of the circuit board 50, whereas in the through hole arrangement of FIG. 5B, the terminal tails M which are supported on different leaf portions 64, 65 are spaced apart from each other so that they may project through holes formed in the circuit board 50.

Figure 4:
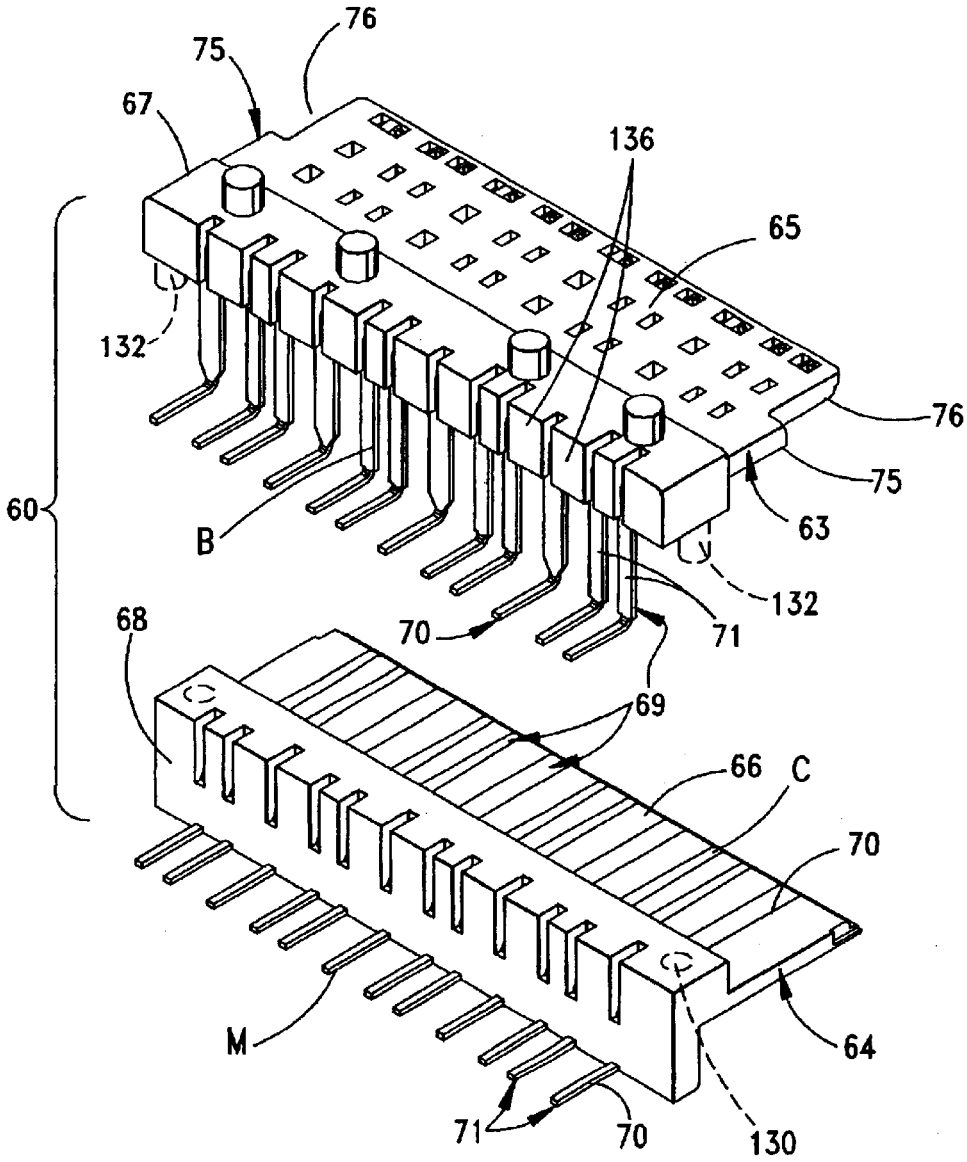
FIG. 4 is an exploded view of the leaf housing of the circuit board connector of claim 3.
Figure 5A:
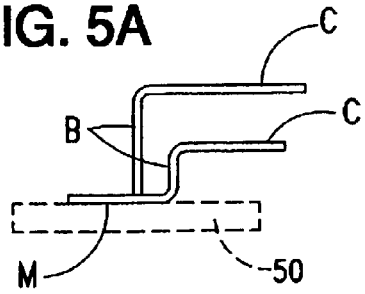
FIG. 5A is a diagrammatic view of the terminal arrangement of the receptacle connector in a surface mount configuration.
Figure 5B:
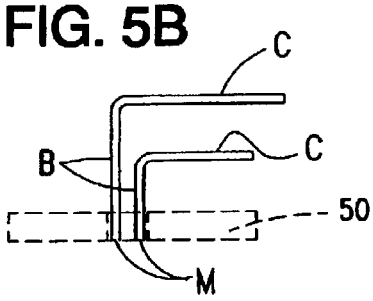
FIG. 5B is a diagrammatic view of the terminal arrangement of the receptacle connector in a through-hole configuration.

Returning to FIG. 3, the receptacle connector 51 includes an inner housing 60 that may be formed from two interfitting body portions 63, 64 that may snap, press fit or otherwise mate together to form the inner housing or body 60 of the connector 51. As shown in FIG. 4, the contact portions "C" of the terminals are supported on the leaves, or blades 65, 66 of the body portions 63, 64 and the engagement between the two preferably occurs between or along the rear wall portions 67, 68 thereof. Once the body portions 63, 64 are assembled together, the rear or outer housing portion 62 (FIGS. 2 & 3) may be molded to or over portions of the inner housing 60 so as to secure the body portions 63, 64 together and surround and/or isolate the terminals of the receptacle connector at least insofar as the body portions "B" thereof are concerned.

In order to provide good engagement between the inner housing 60 and the rear, outer housing 62, the body 134 of the rear outer housing 62 may be provided with openings 135 that may be considered as windows, or passage, which receive complementary-shaped lugs, or projections 136, that are preferably formed as part of the inner housing 60, and which are shown in FIG. 3 as being formed as part of the upper second part 63. These lugs 136 are supported by intervening slots 137. The rear outer housing 62 may be snap fit, or pressed, onto the inner housing 60, or it may be molded together over the inner housing 60.

The side edges 75 of one of the housing blades 65 are preferably provided with notches, or recesses 76, the purpose of which is explained in greater detail below. As stated above in the Summary section, the terminals 70, 71 are arranged along the housing blades 65, 66 in groups of three with the associated ground terminal 70 of each triad being supported on one of the housing blades while the two differential signal terminals 71 of the triad are supported on the other of the two housing blades. This sequence is alternated, or inverted, widthwise along the inner housing 60.

Figure 6:
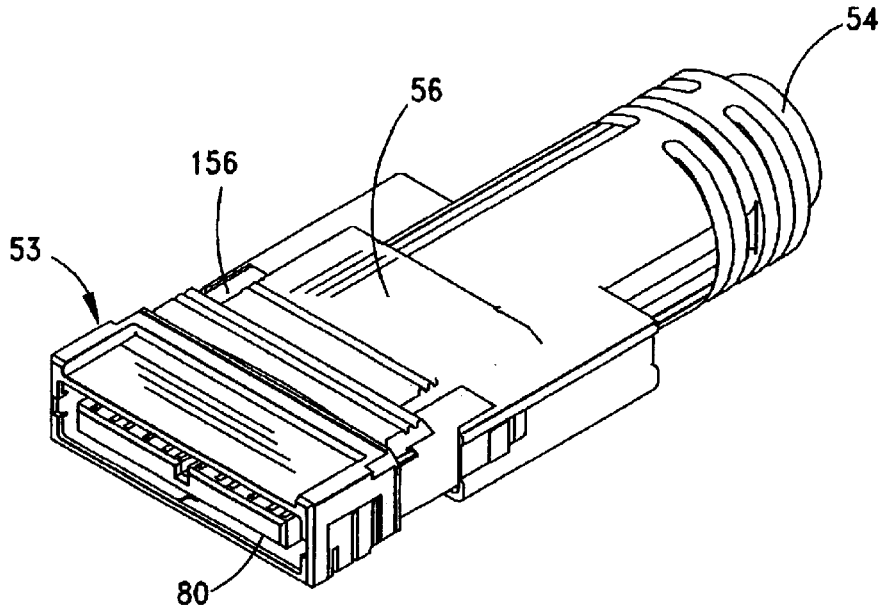
FIG. 6 is a perspective view of a plug (cable) connector used in the connector assembly of FIG. 1.
Figure 9:
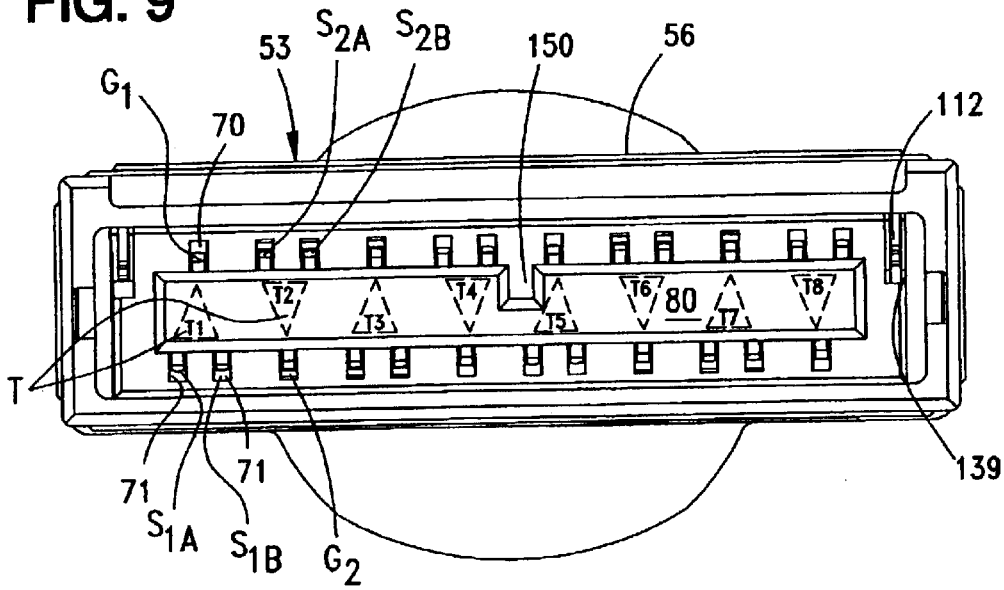
FIG. 9 is a front elevational view of a plug connector of FIG. 6.
Figure 10:
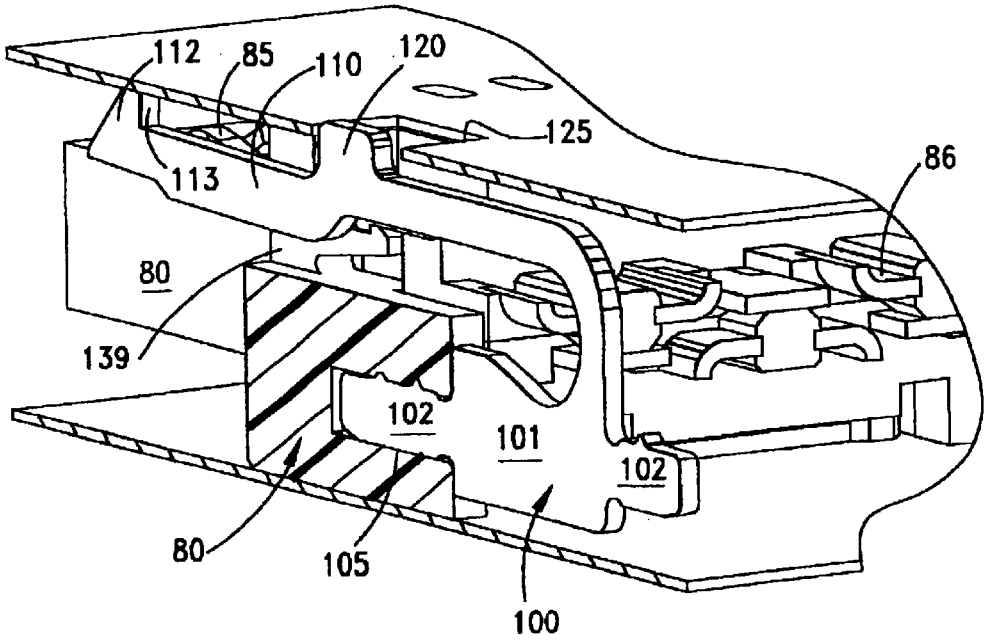
FIG. 10 is a sectional view of the plug connector illustrating the positioning of the latching member within the plug connector body portions and enclosed by the plug connector shield.

Turning now to FIGS. 6 and 9, this terminal arrangement sequence is repeated for the plug connector where two signal terminals are supported on alternating surfaces of the plug member 80 so that a series of imaginary triangles "T" are formed in an inverted fashion. Eight such terminal triads T1–T8 are shown in FIG. 6 and the alternating sequence is clearly shown. The two center triads T4, T5 need not be traditional triads of signal and ground, but may be other types of terminals, such as ones dedicated to power in and return or status information. The benefits and other structural details about such an inverted terminal triad arrangement are set forth in International Patent Application No. PCT/US02/18372, the disclosure of which is hereby incorporated herein by reference.

Figure 7:
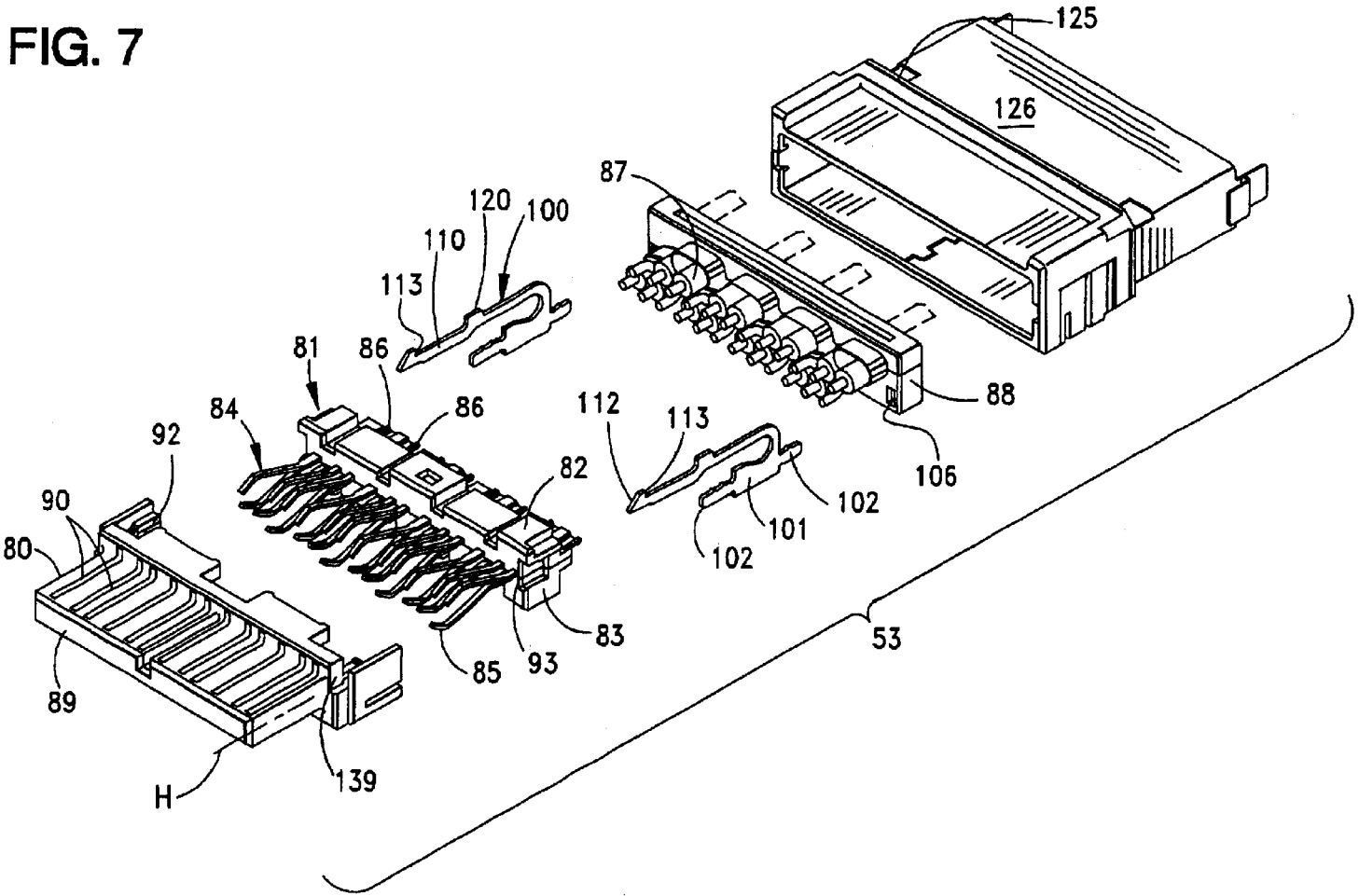
FIG. 7 is an exploded perspective view of the components of the plug connector of FIG. 6.

As best seen in FIG. 7, the plug connector 53 includes an insulative inner body portion 81 that is preferably formed as two pieces 82, 83 and which support a plurality of elongated, conductive terminals 84 thereon. The terminals 84 have contact portions 85 on one end and termination portions 86 on the other end to which a plurality of differential signal cables 87 are terminated. These cables 87 may be held in place with an insulative wire management support member 88 that is in turn, received within an outer protective cover 56. (FIG. 2.) The inner body portion 81 preferably has a plurality of slots 90 that receive single terminals 84 therein. Although this plug member 80 provides some retention force to the connector assembly, in certain applications, more retention force is desired, especially in situations as shown in the drawings where multiple differential signal cables are held within an exterior cable 54, the diameter of which will typically equal or exceed 11 mm. This large size exerts a strain or pull out force on the plug connector when mated to the receptacle connector, due to its weight. In order to resist part of that force, the rear outer housing 62 may be provided with attachment legs 94 that extend out from, in a rearward fashion, the body of the rear housing 52. These legs 94 may be hollow as illustrated in FIGS. 2 & 3 to receive mounting screws, or bolts 95, therein which extend through the circuit board 50 and which hold the two components together using nuts 96.

The inner plug member 81 engages an outer plug end 80 that has a mating portion 89 that projects from (forwardly) a rear portion 91 that engages the inner plug member 81. The projecting mating portion is received within a corresponding opposing mating slot or receptacle of the circuit board connector 51. Raised shoulders 92 are received within slots 93 disposed at opposing ends of the inner plug member 81. Slots 90 are formed in the mating portion 80 and these slots receive the terminal 81 lengthwise, with one terminal being received within a single slot. The terminals 84, as shown in the drawings, have a bent profile such that their contact portions 85 extend upwardly through the plug member mating portion slots 90, as is known in the art. These raised profiles 85 will deflect slightly as they contact the opposing terminals of the receptacle connector.

Figure 11:
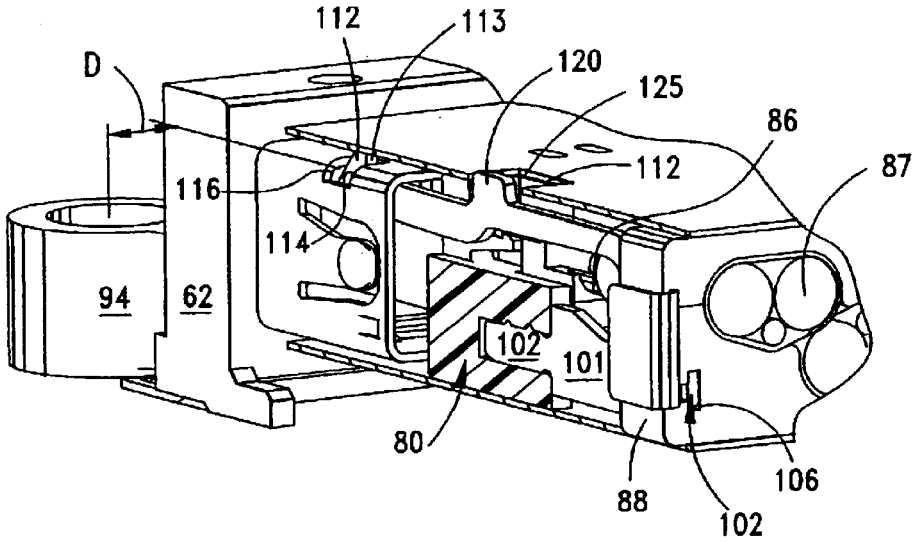
FIG. 11 is a perspective sectional view of the plug connector mated together with an opposing receptacle connector; and, FIG. 12 is a top plan detail view of the plug and receptacle connectors of the connector assembly mated together.

In an important aspect of the present invention, and as illustrated in FIGS. 7 and 8 and 10 and 11, one of the two connectors, preferably the plug connector 53, is provided with one or more latching members 100, two of which are shown. These latching members 100 are secured to the inner housing 81 of the plug connector by way of retention or body portions 101 that have barbed retainer legs 102 or the like that extend therefrom. Two such legs 102 are shown extending from the retention portion 101 in opposite directions and are received within corresponding opposing passages 105, 106 that are formed in the plug member 80 (FIG. 10) and in the wire management member 88 (FIGS. 7 & 11).

Figure 8:
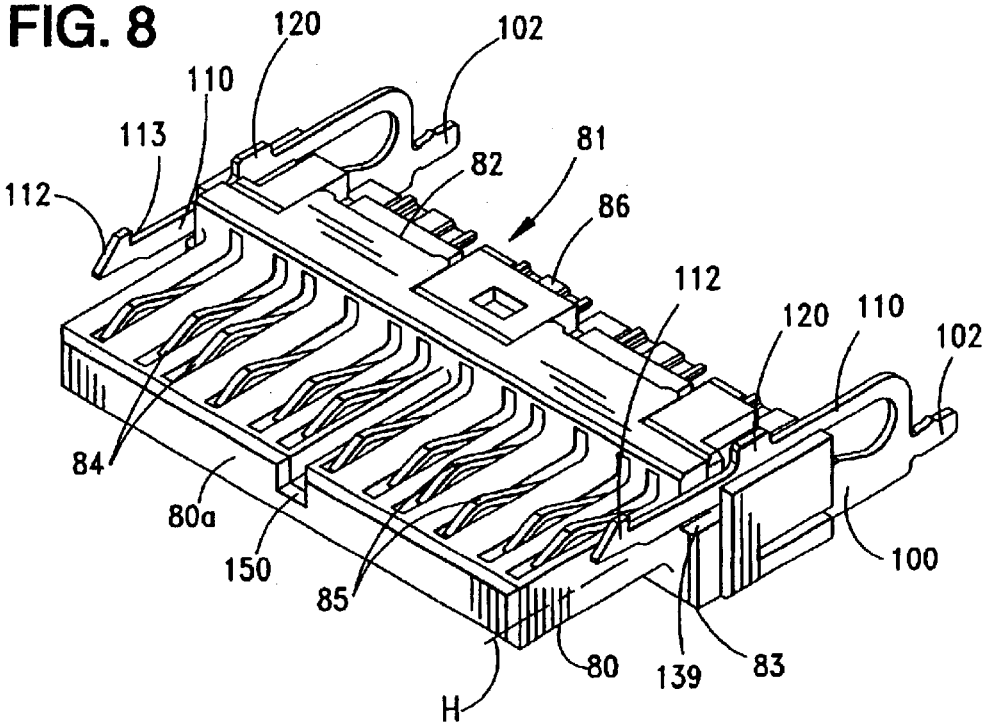
FIG. 8 is a perspective view of the plug connector housing body portion with its terminals in place and with the latching members in place therein.

Each latching member 100 is shown as having an elongated latching arm 110 that extends, in a cantilevered fashion forwardly of the retention portion 101 and forwardly along the inner body portions 81 and above the blade member 80. The latching arms 110 extend through slots, or grooves 139, formed along the ends of the plug mating member 80, as best shown in FIG. 8. An upwardly protruding latch, in the form of a hook 112 is disposed at the forward, latching end of the latching member 100. This hook 112 has rearward facing engagement face 113 that abuts in a confronting fashion, a stop or engagement surface 114 formed in a latching slot 116 formed in the outer shield 61. (FIG. 11.) This slot 116 is aligned with the notches 76 of the inner housing 60 so that the latching member 100 may be inserted therein without fear of impinging or stuffing on an interval surface of the receptacle connector. The latching hook 112, as shown in FIG. 8, extends alongside the projecting mating blade of member 80 and is preferably spaced rearwardly from the front face 80*a* (FIG. 8) thereof so that the latching will occur within the enclosed mating area of the connector and so the latch hook 112 will not be exposed and open to stubbing.

An actuator lug 120 is preferably also formed on the latching arm 110 and extends outwardly and upwardly therefrom through an opening 125 formed in the outer conductive shell 126 of the plug connector 53. This provides a means by which to release the latch hook 112 from its engagement with the opposing stop surface 114 of the connector slot 116 by which the user can depress the actuator lug and disengage the latch hook 112. The outer conductive shell 126 is itself housed within the exterior, insulative sheath 56, as shown in FIG. 6, and the sheath may be provided with an interior shoulder or projection 156 that is positioned so that it abuts against the actuator lug 120. By pressing on these shoulder areas 156, the user can depress the latching hook 112 out of engagement with the opposing mating connector 51.

The latching members 100 are preferably maintained above or below the level of the plug member 80 so as to better resist the disengagement forces that are likely to result from the dead weight of the cable or checking the connections for integrity. The use of the latching member 100 increases the positive retention force required to disengage the two connectors to resist approximately 30 lb. shock load and possibly higher.

Figure 12:
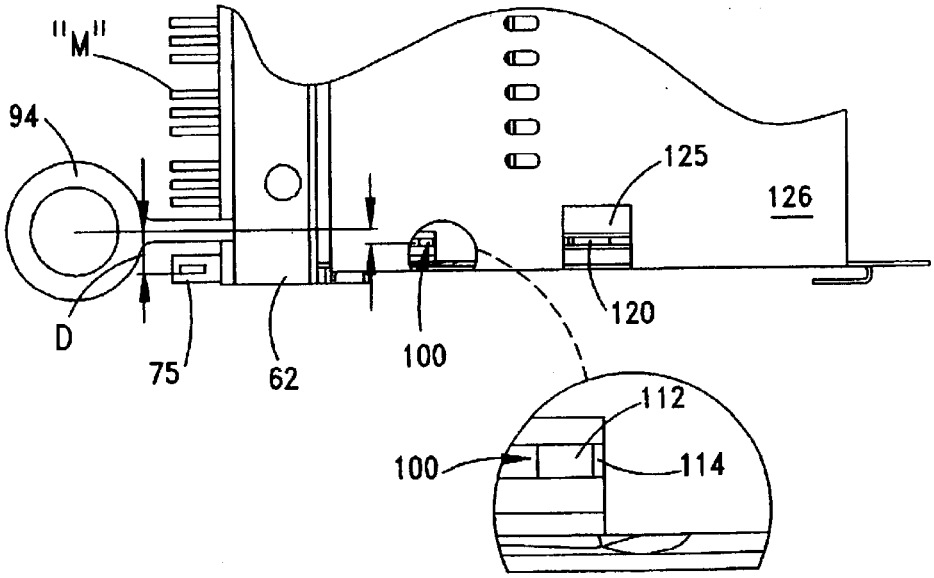

The latching members 100 are positioned and enclosed inside of the plug shield and/or housing as mentioned above so that they are protected and will not be susceptible to damage. The latching members 100 have their latching arms 110 preferably positioned above the horizontal insertion axis H of the connector mating portion to resist the typical pulling force that is exerted downwardly and outwardly. The latching members 100 serve to maintain the engagement between the two connectors and hence maintain the contact between the terminals of each triad. The latching members 100 and the windows or slots 116 are preferably either aligned with the longitudinal axis of the attachment legs 94 (FIGS. 11 and 12) of the receptacle connector 51, or are offset therefrom a distance "D" that is preferably about 1 mm and no more than 3 to 4 mm. In this manner, the engagement of the terminals are reliably maintained within each triad.

It will be understood that the invention may be embodied in other specific forms without departing from the spirit thereof. The present examples and embodiments, therefore, are to be considered in all respects as illustrative and not restrictive, and the invention is not to be limited to the details given herein.

What is claimed is:

1. A latching connector for use in differential signal applications, comprising:

an insulative housing supporting a plurality of conductive terminals in at least two rows of terminals, the housing including a body portion and a mating plug portion extending outwardly therefrom, the terminal rows being disposed on opposite surfaces of said mating plug portion, each of said terminals including at least a contact portion and a tail portion, the terminal contact and tail portions extending out from opposite sides of said housing body portion, the housing mating plug portion is engageable with said housing body portion and said housing mating plug portion includes a plurality of slots disposed therein which receive said terminals therein;

preselected groups of three of the terminals defining distinct differential signal transmission channels in the housing, each of the differential signal transmission channels including a pair of differential signal terminals disposed adjacent each other in one of said terminal rows and a ground terminal disposed in the other of said terminal rows in opposing relationship to the ground terminal, the differential signal transmission channels being arranged consecutively along the rows in an alternating, inverted sequence such that within each of said rows, said pair of differential signal terminals of one of said differential signal transmission channels is adjacent to a ground terminal of a different differential signal transmission channel; and a latching assembly supported by said housing for engaging a mating connector and holding said connect and the mating connector together in a mated condition.

2. The latching connector of claim 1, wherein said differential signal and ground terminals of each of said differential signal transmission lines are arranged with pieces of an imaginary triangle when viewed from a front of said connector.

3. The latching connector of claim 1, wherein the latching assembly includes a pair of latching member disposed on opposite ends of said housing, each latching member including a cantilevered latching arm that extends forwardly of said housing outside of said terminals.

4. The latching connector of claim 3, wherein said latching arms include free ends that terminate in latching hooks, the latching hooks being maintained at a level spaced apart from an insertion axis of said housing plug portion.

5. The latching connector of claim 4, wherein said latching arm and latching hooks are maintained above the housing plug portion insertion axis.

6. The latching connector of claim 3, further including a cable holder associated with said housing for holding a plurality of cables in a preselected position with respect to said housing.

7. The latching connector of claim 6, wherein said latching members are held in place in said connector between said housing and the cable holder.

8. The latching connector of claim 7, wherein said latching members include retention legs that respectively engage said housing body and said cable holder.

9. The latching connector of claim 8, wherein each of said latching members includes a body portion and the retention legs project outwardly from two sides of the body portion and said latching arm projects outwardly from another side of said body portion.

10. The latching connector of claim 9, wherein said retention legs project from two opposing sides of said body portion and said latching arm projects from said body portion intermediate said retention legs.

11. The latching connector of claim 1, further including a conductive shield encompassing said housing and terminals, to define a hollow enclosure that receives a portion of a mating connector therein, the latching assembly including a pair of spaced apart latching members that extend alongside said housing within the conductive shield hollow enclosure.

12. The latching connector of claim 11, wherein said latching members are spaced apart widthwise of said connector housing a preselected distance so as to engage a mating connector outside of points of attachment of the mating connector to a circuit board.

13. The latching connector of claim 11, wherein said latching members are structured and arranged to resist separation of said connector from a mating connector by a separation of force of less than thirty pounds (30 lbs).

14. The latching connector of claim 11, further including a cable holder for holding cables in position with respect to said hosing body portion and said latching members include a pair of retention legs that respectively engage the cable holder and said housing body portion.

15. The latching connector of claim 11, wherein said latching members include actuator arms for disengaging said latching members from a mating connector.

16. The latching connector of claim 15, wherein said latching members each include a body portion supported by said housing, a latching arm extending from the body portion and terminating in a latching hook, the actuator arm being disposed on the latching arm at a location between the latching hook and said body portion, said conductive shield including openings disposed therein in opposition to said actuator arms so that said actuator arms are received within the conductive shield openings.

17. The latching connector of claim 16, wherein said latching arm extends above said latching member body portions.

18. A connector for use in differential signal applications, comprising:

an insulative housing supporting a plurality of conductive terminals in at least two rows of terminals, preselected groups of three of the terminals defining distinct differential signal transmission channels in the housing, each of the differential signal transmission channels including a pair of differential signal terminals disposed adjacent each other in one of said terminal rows and a ground terminal disposed in the other of said terminal rows in opposing relationship to the ground terminal, the differential signal transmission channels being arranged consecutively along the rows in an alternating, inverted sequence such that within each of said rows, said pair of differential signal terminals of one of said differential signal transmission channels is adjacent to a ground terminal of a different differential signal transmission channel;

a latching assembly supported by said housing for engaging a mating connector and holding said connector and the mating connector together in a mated condition, the latching assembly including a pair of spaced-apart latching members that are supported between said housing and an end member, each latching member including a latching arm that extends forwardly of said housing.

19. The connector of claim 18, wherein the end member supports a plurality of cables in a preselected position with respect to said housing.

20. A latching connector for use in differential signal applications, comprising:

an insulative housing supporting a plurality of conductive terminals in at least two rows of terminals, and a conductive shield encompassing the housing and terminals, to define a hollow enclosure that receives a portion of a mating connector therein;

preselected groups of three of the terminals defining distinct differential signal transmission channels in the housing, each of the differential signal transmission channels including a pair of differential signal terminals disposed adjacent each other in one of said terminal rows and a ground terminal disposed in the other of said terminal rows in opposing relationship to the ground terminal, the differential signal transmission channels being arranged consecutively along the rows in an alternating, inverted sequence such that within each of said rows, said pair of differential signal terminals of one of said differential signal transmission channels is adjacent to a ground terminal of a different differential signal transmission channel; and, a latching assembly supported by said housing for engaging the mating connector and holding said connector and the mating connector together in a mated condition, the latching assembly including a pair of spaced-apart latching members that extend alongside said housing within the conductive shield hollow enclosure.

21. The latching connector of claim 20, wherein said members include free ends that terminate in latching hooks, the latching hooks being maintained at a level spaced apart from an insertion axis of said housing plug portion.

22. The latching connector of claim 21, wherein said latching hooks are maintained above the housing plug portion insertion axis.

* * * * *